United States Patent [19]

Hoehn

[11] 4,143,695

[45] Mar. 13, 1979

[54] PICNIC CHEST

[75] Inventor: Dalton Hoehn, Zimmerman, Minn.

[73] Assignee: Dart Industries Inc., Los Angeles, Calif.

[21] Appl. No.: 921,611

[22] Filed: Jul. 3, 1978

[51] Int. Cl.[2] ..... A45C 11/20

[52] U.S. Cl. ..... 150/52 R; 220/215; 220/334

[58] Field of Search ..... 150/2.1, 52 R, 52 F; 220/215, 334, 255

[56] References Cited

U.S. PATENT DOCUMENTS

| | | | |
|---|---|---|---|
| 2,562,609 | 7/1951 | Frohnapel | 220/215 |
| 2,592,412 | 4/1952 | Frohnapel | 220/334 |
| 2,857,949 | 10/1958 | Ziff | 150/52 R |

*Primary Examiner*—Donald F. Norton

*Attorney, Agent, or Firm*—Kenneth J. Hovet

[57] ABSTRACT

A chest suitable for use in picnicking formed by an upwardly opening container and lid structure for closing same. The lid has a central portion interposed between end portions. The lid end portions are hinged to the lid central portion to permit partially opening of the chest at its opposite ends. The lid central portion is further detachably hinged to the side walls of the container at diametrically opposed points to permit full opening of the chest or complete removal of the lid therefrom. The chest disclosed is formed by enclosing selectively dimensioned pieces of rigid heat insulating material in flexible waterproof covering material along with additional insulation material. Snap fastener mechanism associated with flaps joined with the lid central portion may be employed for detachably connecting the lid on the container structure.

10 Claims, 7 Drawing Figures

PICNIC CHEST

BACKGROUND OF THE INVENTION

The present invention relates to chests suitable for holding foods, and more particularly to an improved form of such chests suitable for use in picnicking.

SUMMARY OF THE INVENTION

It is an object of the present invention to provide an improved chest for use in picnicking characterized by having a lid portion which when in situ may be selectively opened in three different ways and which further may be selectively removed in its entirety when desired.

It is further an object of the present invention to provide an improved picnic chest characterized by being of improved inexpensive construction.

It is also an object of the present invention to provide an improved picnic chest as set forth characterized by being of both heat insulative and waterproof construction.

In accomplishing these and other objects, there is provided in accordance with the present invention a chest suitable for use in picnicking formed by an upwardly opening container suitable for holding food and lid structure for closing the container structure. The lid has a central portion interposed between end portions, and the lid end portions are hinged to the lid central portion to permit partially opening of the chest at its opposite ends. The lid central portion is further detachably hinged to the side walls of the container at diametrically opposed points to permit full opening of the chest or complete removal of the lid therefrom.

The chest may be formed by enclosing selectively dimensioned pieces of rigid heat insulating material in flexible waterproof covering material along with additional insulation material. Snap fastener mechanism associated with flaps joined with the ends of the lid central portion may be employed for detachably connecting the lid on the container structure.

Additional objects of the present invention reside in the specific construction of the exemplary embodiment of picnic chest hereinafter described and shown in the several drawing figures associated with this specification.

DETAILED DESCRIPTION OF THE PREFERRED EMBODIMENT

Figure 1:
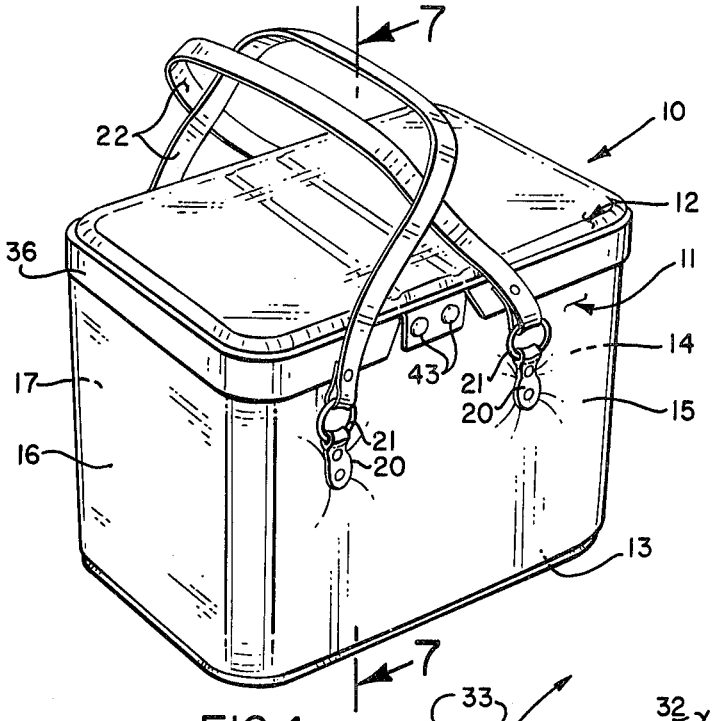
FIG. 1 is a perspective view of a picnic chest according to the present invention shown with its lid structure completely closed.

Referring to the drawings in more detail, there is shown a picnic chest generally identified by the numeral 10. The chest 10 is formed of upwardly opening container structure 11, suitable for holding food, and lid structure 12.

The container structure 11 illustrated is formed by a rectangular rigid bottom wall 13 bounded by four substantially rigid side walls 14, 15, 16 and 17. Each of the side walls 14–17 are rectangular in shape and extend perpendicularly to the bottom wall 13 so as to define the container structure 11 as a rectangular box bounded by an upper edge 18, the edge 18 lying in a plane parallel to the bottom wall 13. The walls 14 and 16 define the transverse dimension or width of the container 11 while the side walls 15 and 17 define its length or longitudinal dimension.

Longitudinal spaced apart tabs 20 carrying rings 21 are secured on the container side walls 15 and 17. Straps 22 are secured to the rings 21 for use in carrying the chest 10.

The lid structure 12 illustrated is formed by a central portion 30 interposed between end portions 31 and 32. The lid central portion 30 is an elongated rigid planar rectangular member having mutually parallel side and end edges, respectively. The lid end portions 31 and 32 are each formed by substantially square-shaped rigid planes 33 which are joined along one of their edges in hinged connections 34 and 35 to the side or longitudinal edges of the central portion 30. Depending from the other edges of the planes 33 is rim structure 36 which extends perpendicularly therefrom downwardly to overlap and fit around the upper container edge 18.

Rigid rectangular flaps 40 are joined in hinged connections 41 and 42 to the opposite ends of the lid central portion 30. The flaps 40 illustrated extend from the central portion 30 approximately the same distance as the rim structure 36 from the planes 33.

Secured on the flaps 40 are the female portions 43A of snap fastener devices 43. The male portions 43B of the snap fasteners 43 are centrally located along the outside of the container side walls 15 and 17 to detachably mate with the female portions 43A.

As shown by FIG. 1, the snap fasteners 43 function to detachably secure the ends of lid central portion 30 by hinged connections to the side walls 15 and 17 at diametrically opposed points. Further, as shown by FIG. 1, with the lid structure 12 in situ to close the chest 10, the lid 12 has the shape of a rectangularly shaped inverted pan.

Figure 2:
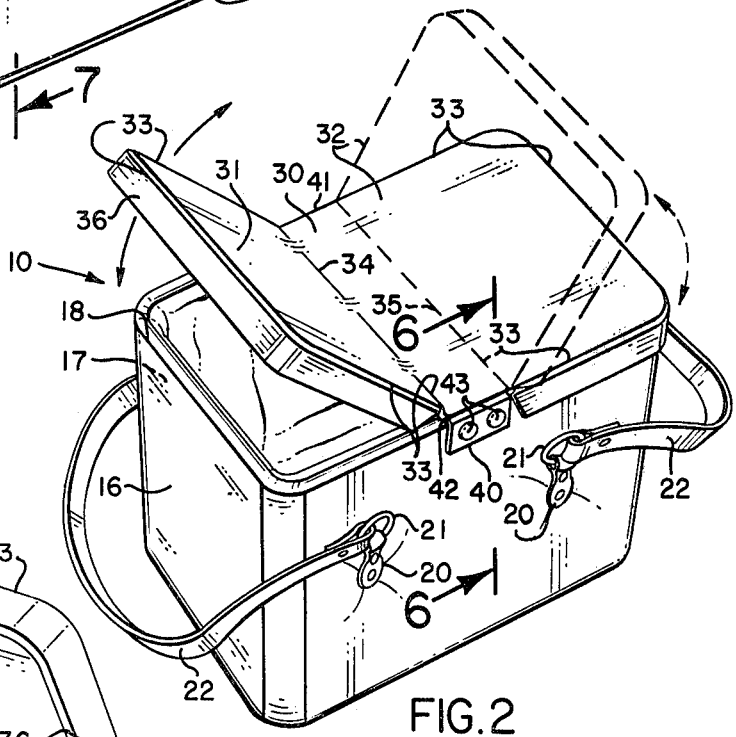
FIG. 2 is a perspective view of the chest of FIG. 1 showing one lid end pivoted open to partially open the chest.

In FIG. 2, the chest 10 is shown partially opened by pivoting the lid end 31 upwardly along its hinged line of connection 34 with the lid central portion 30. The lid end portion 32 could be simiarly opened to provide access to the other end of the picnic chest 10.

Figure 3:
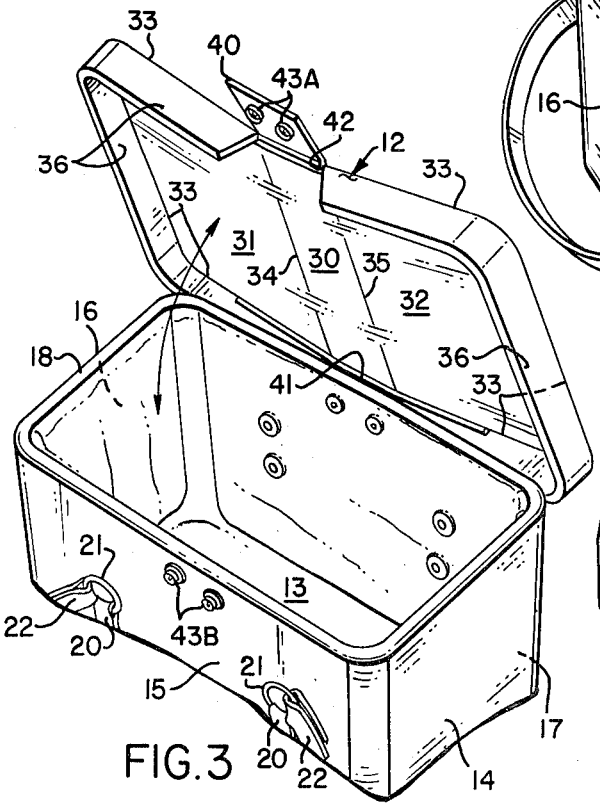
FIG. 3 is a perspective view of the chest of FIG. 1 showing the lid structure itself pivoted open to fully open the chest.
Figure 4:
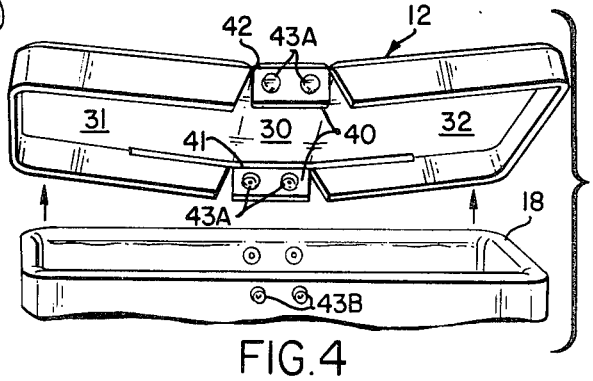
FIG. 4 is an exploded perspective view of the chest of FIG. 1 showing its lid structure completely detached from the remainder of the chest.

FIG. 3 illustrates one of the flaps 40 selectively detached so that the entire lid structure 12 pivots about the hinged line of connection 41 of the other flap 10 to completely open the chest 10. In FIG. 4, the lid structure 12 is completely removed from the chest 10 by selectively detaching both flaps 40.

Figure 5:
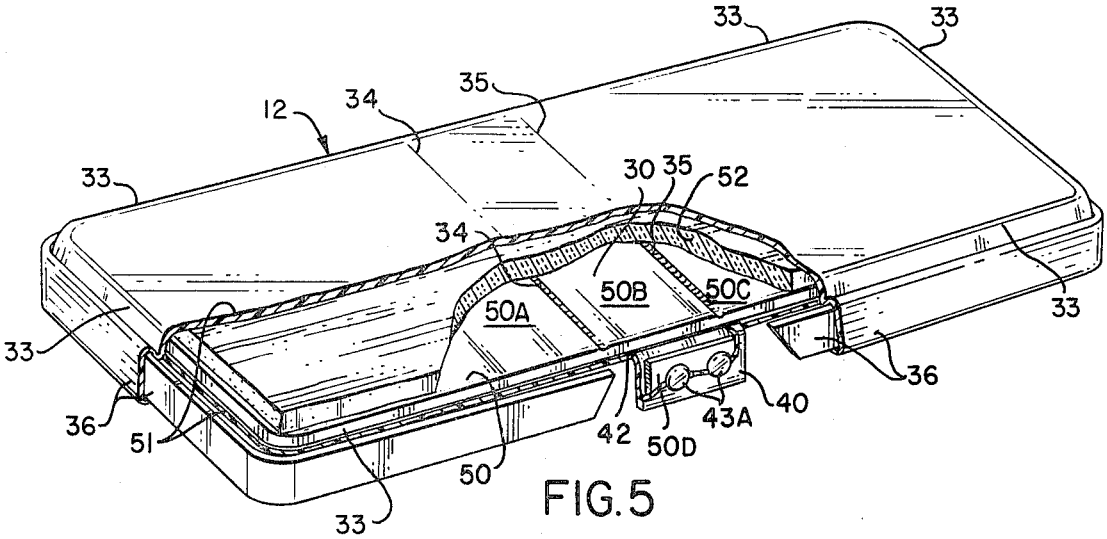
FIG. 5 is a partially cutaway view of the lid structure of the chest of FIG. 1.
Figure 6:
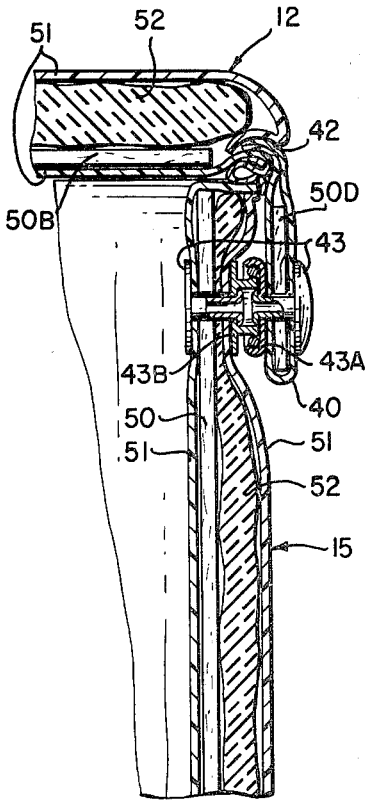
FIG. 6 is a cross-sectional view taken along the line 6—6 of FIG. 2.
Figure 7:
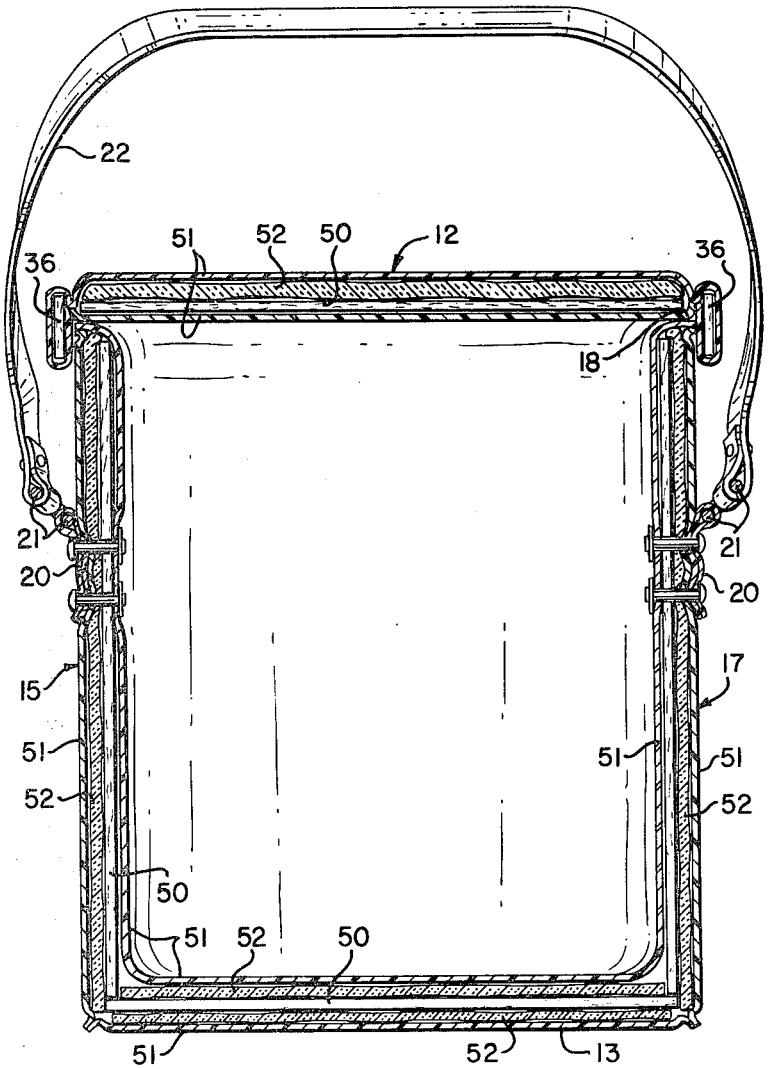
FIG. 7 is a cross-sectional view taken along the line 7—7 of FIG. 1.

The construction of the various wall sections and hinges making up the chest 10 is shown in FIGS. 5–7. Each of the wall sections is defined by a rigid heat insulating member 50 covered over by a flexible, fitted waterproof material 51 with insulation 52 interposed therebetween. The hinges are defined by the junctions between certain of the insulating members 50, with the flexible covering material 51 defining the bending portions of the hinges. Fiberboard may be used to form the rigid members 50 while waterproofed vinyl may be used as the covering material 51.

Referring to FIG. 5, it can be seen that the junction of the rigid members 50A and 50B define the hinged connection 34 while the junction of the rigid members 50B and 50C define the hinged connection 35. FIG. 7 illustrates that the hinged connections 41 and 42 are defined, respectively, by the junctions of rigid members 50D, 50B and 50E, 50B.

Thus, an improved chest for use in picnicking has been shown and described.

It is noted that although the invention has been shown and described herein in what is conceived to be the most practical and preferred embodiment it is recognized that departures may be made from the preferred embodiment within the invention's scope.

What is claimed is:

1. A chest for use in picnicking, comprising:

upwardly opening container structure suitable for holding food, said container structure being formed by bottom wall means bounded by side wall means, said side wall means having upper edge means which define the upper open end of said container structure;

lid means for closing said container structure, said lid means being dimensioned to fit over the upper open end of said container structure to substantially close same, said lid means being made of a central lid portion interposed between first and second lid end portions, said central lid portion having diametrically opposed first and second ends with first and second substantially parallel longitudinal edges extending therebetween;

first hinge means for hingedly connecting said first lid end portion with said central lid portion along its first longitudinal edge;

second hinge means for hingedly connecting said second lid end portion with said central lid portion along its second longitudinal edge;

third hinge means for detachably and hingedly connecting said central lid portion along its first end to said container side wall means at one of two selected substantially diametrically opposite points on said container side wall means; and fourth hinge means for detachably and hingedly connecting said central lid portion along its second end to said container side wall means at the other of said two selected substantially diametrically opposite points on said container side wall means whereby a picnic chest is provided from which said lid means may be selectively removed by detaching said third and fourth hinge means, on which said lid means may be pivoted to fully open said chest by detaching only one of said third and fourth hinge means, or in which said chest may be partially opened on opposite ends by pivotally opening said first and second lid end portions.

2. The invention defined in claim 1, wherein said lid means fits around and encloses the outer periphery of said upper edge means.

3. The invention defined in claim 2, wherein said lid means defines a downwardly extending rim which fits around the outer periphery of said upper edge means.

4. The invention defined in claim 1, wherein third and fourth hinge means include snap fastener means for connecting said central lid portion to said container side wall means.

5. The invention defined in claim 1, wherein said picnic chest is made of selectively dimensioned pieces of substantially rigid heat insulating material covered by and enclosed in flexible substantially waterproof covering material, said flexible covering material defining the bending portions of said hinge means.

6. The invention in claim 1, wherein said picnic chest includes handle means for carrying same.

7. The invention defined in claim 1, wherein said container structure is formed by a rectangularly shaped bottom wall bounded by four side walls.

8. The invention defined in claim 1, wherein:

the shape of each of said bottom and side walls is defined by a substantially rectangular rigid heat insulating member; and said container structure includes flexible waterproof covering material which encloses and covers over said rigid members defining said bottom and side walls to form said container structure as a rectangular box bounded by an upper edge lying in a plane substantially parallel to said bottom wall; and said lid means is substantially pan shaped to open downwardly and fit over and around said upper edge defining the upper open end of said container structure.

9. The invention defined in claim 8, wherein:

said central lid portion and said third and fourth hinge means are formed by a rigid transverse member disposed to extend across the upper open end of said container structure having flaps secured on opposite ends, said flaps being for detachable connection to said container side walls and the junction between said flaps and transverse member defining the hinged connection of said third and fourth hinge means; and including:

snap fastener means for detachably connecting said flaps to said container side walls.

10. The invention defined in claim 9, wherein said lid means and said first, second, third and fourth hinge means are formed by enclosing selectively dimensioned pieces of substantially rigid heat insulating material in flexible substantially waterproof covering material, said flexible covering material defining the bending portions of said hinge means.

* * * * *